US005667101A

United States Patent [19]

Barrash et al.

[11] Patent Number: 5,667,101

[45] Date of Patent: Sep. 16, 1997

[54] COLLAPSIBLE BOTTLE

[75] Inventors: Marshall Barrash, Atlanta; William S. Credle, Jr., Stone Mountain, both of Ga.

[73] Assignee: The Coca-Cola Company, Atlanta, Ga.

[21] Appl. No.: 444,730

[22] Filed: May 19, 1995

[51] Int. Cl.[6] ..... B65D 35/00

[52] U.S. Cl. ..... 222/92; 222/481.5; 222/529; 222/530; 222/541.6

[58] Field of Search ..... 222/92, 481.5, 222/527, 528, 529, 530, 538, 541.5, 541.6

[56] References Cited

U.S. PATENT DOCUMENTS

| | | | |
|---|---|---|---|
| 3,204,835 | 9/1965 | Michel | 222/541.5 |
| 4,236,655 | 12/1980 | Humphries | 222/530 X |
| 4,426,027 | 1/1984 | Maynard, Jr. | 222/530 X |
| 4,428,507 | 1/1984 | Sneider | 222/530 X |
| 4,492,313 | 1/1985 | Touzani | 215/1 C |
| 4,773,458 | 9/1988 | Touzani | 222/107 X |
| 4,901,878 | 2/1990 | Humphries | 222/530 X |
| 5,078,286 | 1/1992 | Hashimoto | 222/529 X |
| 5,238,157 | 8/1993 | Gentile | 222/541.5 |
| 5,447,110 | 9/1995 | Brown | 222/530 X |
| 5,472,124 | 12/1995 | Martushev | 222/530 X |

*Primary Examiner*—Joseph Kaufman

*Attorney, Agent, or Firm*—Birch, Stewart, Kolasch & Birch, LLP

[57] ABSTRACT

A fluid dispensing container is disclosed including a collapsible housing, the collapsible housing having first and second opposing end walls and collapsible side walls connecting the opposing end walls. A flexible drinking tube is provided on the collapsible housing, the flexible drinking tube including a first end connected to the collapsible housing and in liquid communication with the interior of the container, a formed tube portion connected to the second opposing end wall of the container, and a second end opposite to the first end for dispensing the contents of the container. The second end of the flexible drinking tube is removably sealed, and the second end of the drinking tube is removably secured to either the formed tube portion or a recessed area within the second end wall of the collapsible housing.

41 Claims, 4 Drawing Sheets

COLLAPSIBLE BOTTLE

BACKGROUND OF THE INVENTION

1. Field of the Invention

The present invention is directed to a fluid dispensing container, and more particularly, to a collapsible fluid dispensing container such as a bottle with a resealable drinking tube and an integral bellows arrangement in the body of the container to enable dispensing of the contents of the container from any orientation.

2. Description of Related Art

Hand-held containers are known in which the contents of the container are squeeze-dispensed. Generally, the known containers are of a box-type construction having a separate straw which may be inserted into the container at the time of dispensing. Usually, the intended dispensing of the contents is by suction through the straw, however, even the slightest pressure on the sidewalls of the box will cause the contents to squirt out through the straw, causing inconvenience to the user. Children have a particularly difficult time since they are prone to hold the container tightly for security thereof, and will therefore cause the contents of the container to inadvertently squirt out through the straw. Further, the known hand-held containers are not resealable after use and are for single serving use and thus, are not reusable as a toy or for further dispensing of a beverage.

Thus, although the known packages work well for their intended purposes, they do not have needed ergonomics; are not reusable; and are not easily refillable. Additionally, the known dispensers are sometimes difficult for young children to manipulate without spillage of the contents during dispensing.

SUMMARY OF THE INVENTION

Accordingly, it is an object of this invention to provide a fluid dispensing container which has improved ergonomics; is resealable facilitating reuse; is refillable; and easy to use without spillage.

The foregoing and other objects of this invention are fulfilled by providing a fluid dispensing container comprising:

- a collapsible housing, said collapsible housing including opposing end walls and collapsible side walls connecting the opposing end walls;
- a flexible drinking tube provided on the collapsible housing, said flexible drinking tube including a first end connected to an interior of said collapsible housing and a second end opposite to the first end for dispensing the contents of said container;
- means for removably sealing the second end of said flexible drinking tube; and
- means for removably securing the second end of said drinking tube to said collapsible housing.

The container further includes a vent opening formed adjacent one of the opposing ends of said collapsible housing.

One of the opposing ends of said collapsible housing includes a recessed area conformally shaped to receive at least a portion of the palm of an operator's hand. The recessed area also has a non-slip surface, the non-slip surface including a plurality of spaced and raised ribs extending from the end of said collapsible container.

The collapsible housing includes pleated sidewalls connecting the opposed end walls, the opposed end walls being rigid, thereby providing an overall accordion shape to the collapsible housing. Further, the collapsible housing is preferably formed of a one-piece construction.

The flexible drinking tube is removably secured to the collapsible housing by a frangible connection adjacent the second end of the flexible drinking tube. The first end of the drinking tube is in liquid communication with the interior of the collapsible housing at one of the opposing ends. Additionally, a portion of the drinking tube is crimped to the upper end of the collapsible housing along substantially an entire width of the housing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DETAILED DESCRIPTION OF PREFERRED EMBODIMENTS

Figure 1:
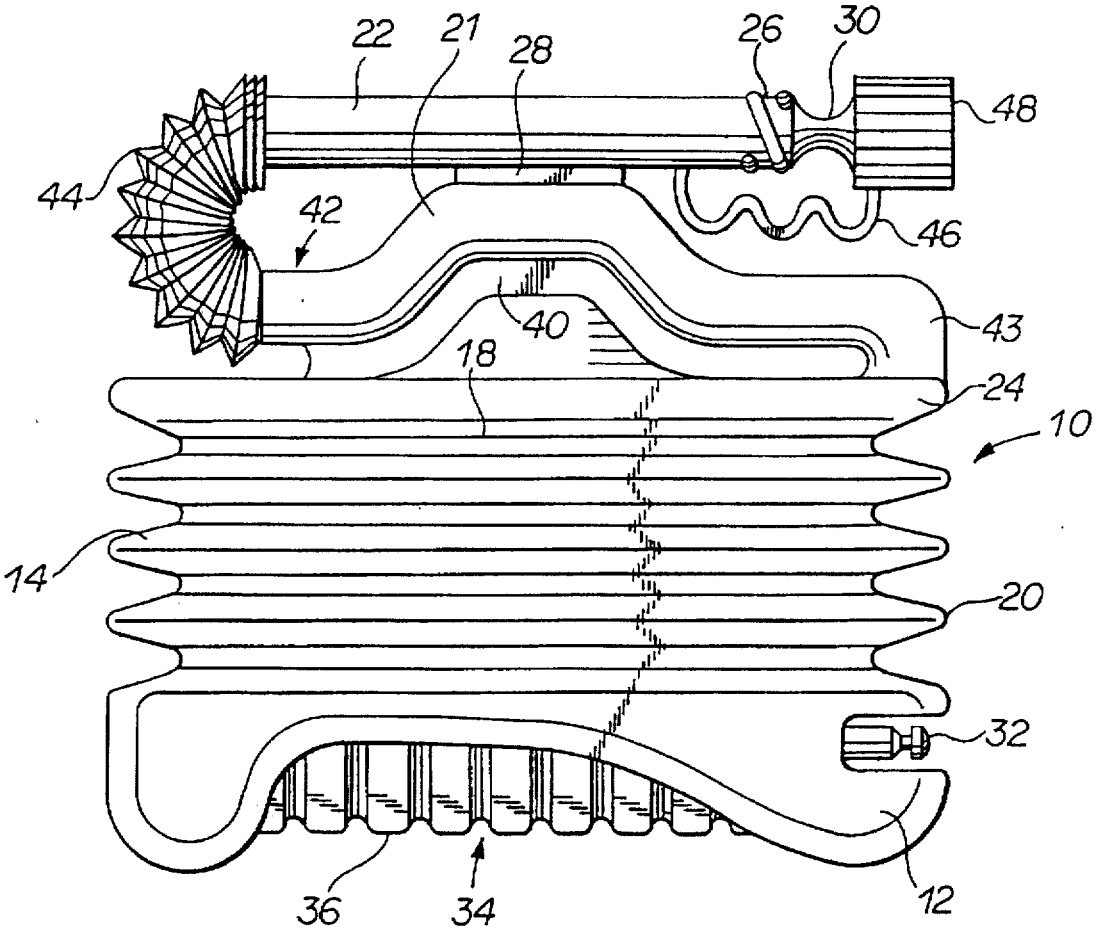
FIG. 1 is a side elevational view of a preferred embodiment of a fluid a dispensing container according to the present invention.
Figure 2:
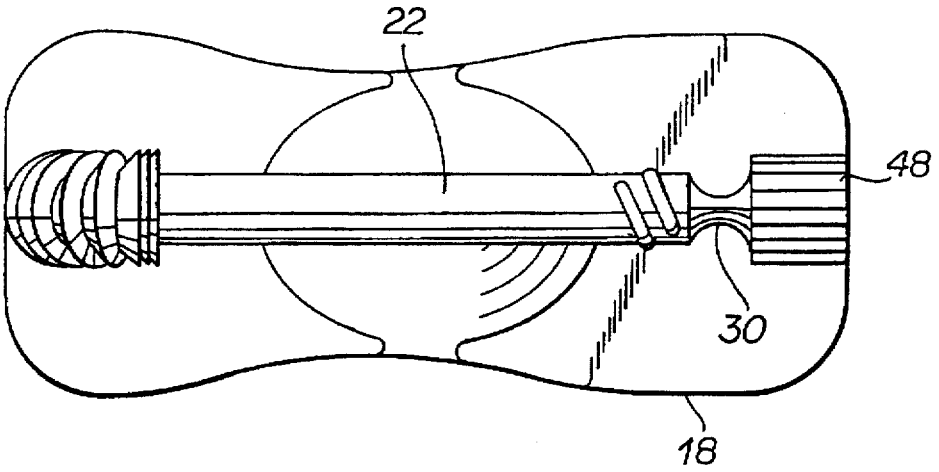
FIG. 2 is a top plan view of the container of FIG. 1.

Referring to FIGS. 1 through 4, fluid dispensing container 10 includes a first end portion 12 defining a first end of a collapsible housing 14. The collapsible housing 14 also includes a second end 18, with the first and second ends being connected by pleated side walls 20.

At the second end 18 of the container 10 there is provided a flexible drinking tube 22 including a formed portion 21 thereof. The drinking tube 22 includes a first end 24 which is in liquid communication with the interior of the collapsible housing 14 at an upper end thereof and a second end 26 which is the drinking or dispensing end of the flexible drinking tube 22. As indicated, the flexible drinking tube is bendable, this bend occurring at a bendable pleated portion 44. The location of the bendable portion depends upon the length of the drinking tube 22, but is preferably substantially flush with the side walls 20 of the collapsible housing 14 and at about the midpoint of the length of tube 22. When tube 22 is in a packaged condition prior to use, it is attached to itself by a frangible connection 28, the frangible connection being breakable upon extending of the tube to a dispensing position during use.

Also provided in connection with the flexible drinking tube 22 is a cap member 48 as shown particularly in FIG. 1, the cap member 48 being attached to the second end 26 of the drinking tube 22 in a packaged condition by a frangible seal 30. The cap member 48 may be removed from the second end 26 of the drinking tube 22 by a twisting motion or the like sufficient to break the frangible seal 30, thereby opening the drinking end or second end 26 of the drinking tube.

In order to retain the cap portion or cap member 48 for later use for resealing of the drinking tube, the cap member 48 is attached to the drinking tube or collapsible container at a location adjacent the first end of the drinking tube by a tether 46. Use of the tether 46 will prevent loss of the cap member 48 upon removing the cap member from the remainder of the drinking tube.

In order to supply the beverage or dispensed contents to the container, a vent opening 32 is provided adjacent the first end portion 12 of the container 10. This vent opening is used for venting headspace of the container during filling through drinking tube 22. It is permanently sealed after filling. If desired, the vent opening is accessible for removal by the consumer for post consumption use so that the consumer may later refill the container for further dispensing of additional contents, or as a toy such as a squirt gun.

Figure 3:
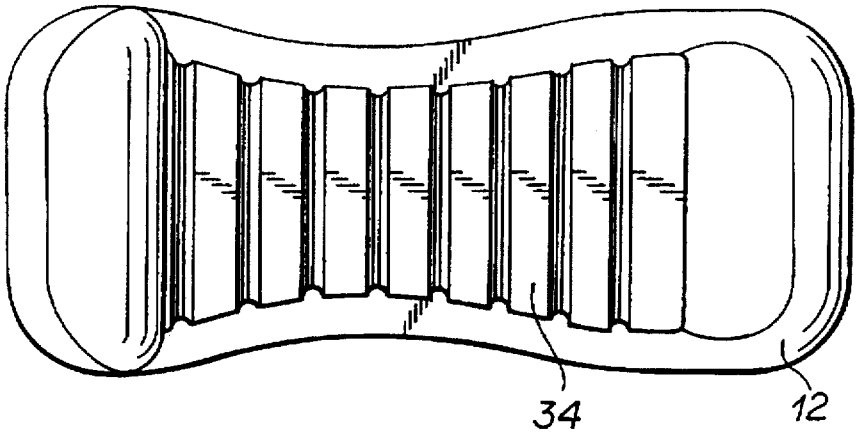
FIG. 3 is a bottom plan view of the container of FIG. 1.
Figure 4:
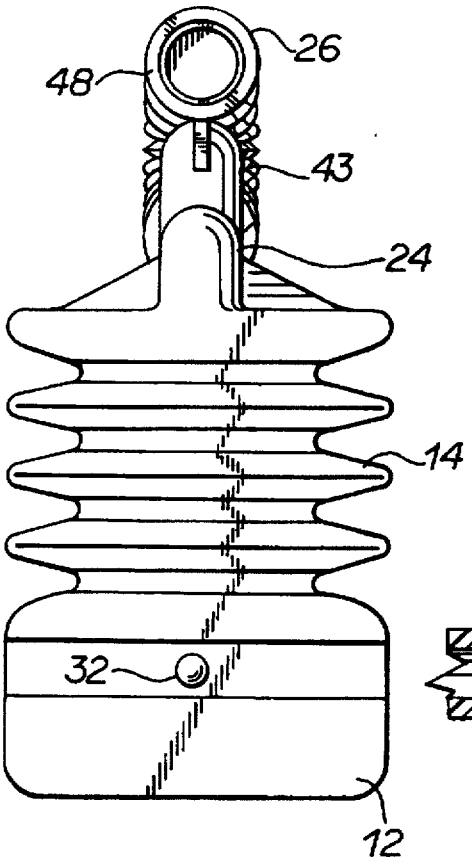
FIG. 4 is a right end elevational view of the container of FIG. 1.

The first end portion 12 of the container as shown in FIGS. 1 and 3, also includes a recessed area 34 which is sized to conformally receive at least a portion of the palm of an operator's hand. The recessed area 34 has a non-slip surface 36 provided by a plurality of spaced ribs extending from the surface of the base portion.

Figure 7:
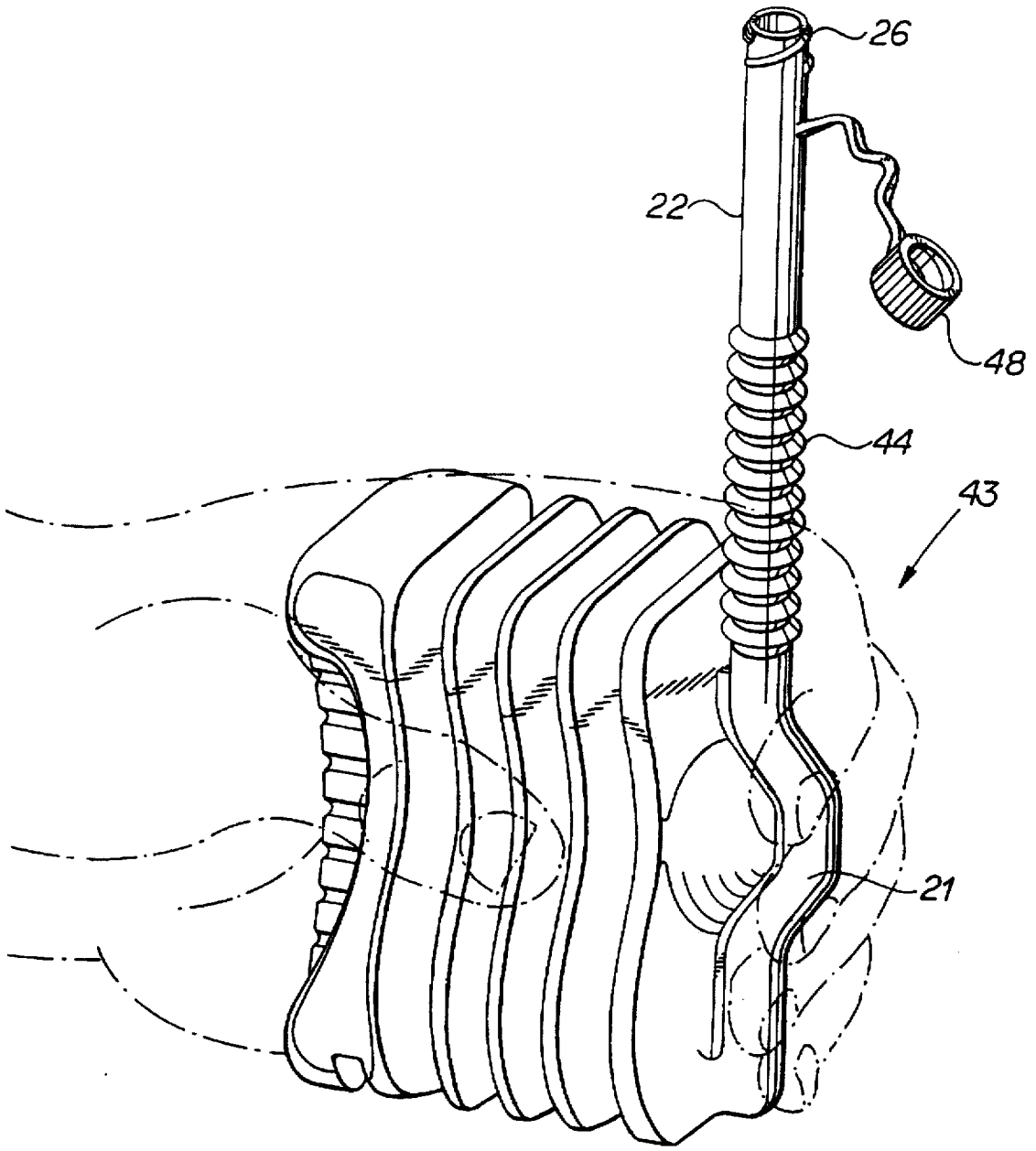
FIG. 7 is a perspective view of the fluid dispensing container of FIG. 1 illustrating how it is gripped by an operator's hand and with the drinking tube extended.

Further, the configuration of the flexible drinking tube 22 defines a finger recess 42 through which a user's finger may be inserted when the first end portion 12 of the container is engaged by a user's palm along recessed area 34 of the first end portion 12. More specifically, as shown in FIG. 7, the palm sized recess 34 of the first end portion 12 conformally engages a user's palm while at least the index finger engages with the finger recess 42.

Of course, if the user is of such an age or size that their hand is not large enough to have the palm fit in the recess 34 while still reaching the first finger up to the finger recess 42, the container is so uniquely constructed that a user's thumb or the pad of a user's thumb will also fit within the recess 34, the palm per se of the user will extend over the pleated sidewalls 20, and at least the first finger of the user will then fit within the finger recess 42 for squeeze-dispensing the contents of the container by compression of the pleated sidewalls 20. In other words, the size and shape of the container is such that it is easily gripped within a single hand for one-handed dispensing of the contents thereof during active play or sporting activities by the user, and further, the user may be of any size or age.

The body of the collapsible housing 14 is preferably formed of pleated sidewalls 20 as shown in the drawings such that the pleated sidewalls 20 connect the opposing ends of the container, resulting in an overall accordion shape. The contents of the container are dispensable by compression of the pleated sidewalls 20 during use.

In order to dispense product from the bottom of the container (as used pursuant to FIG. 7), a hollow portion of the body as substantially defined by the pleated portion 20 is separated from the formed tube 21 of the drinking tube by a solid connector 40 so that liquid is restricted to flow from the first end 24 through the formed tube 21 to the bendable portion 44. The formed tube portion 21 of the drinking tube 22 is attached by the solid connector 40 to the end 18 of the collapsible housing 14 along substantially the entire width thereof. The solid connector 40 may be a crimped extension of the formed tube 21 on the underside thereof, or may simply be molded during formation of the container and drinking tube 22. When the container is in an expanded position, a headspace is formed in the interior of the container over the liquid therein. The curved configuration of the formed portion 21 of the drinking tube 22 effectively forms a sump 43 or a well for collecting liquid separate from the headspace and the contents of the container. The sump area 43 extends through the formed tube 21 to the point 24 at which the drinking tube connects with the interior of the container. Dispensing is achieved primarily either by inducing a vacuum within the container due to suction on the drinking tube 22 or by compression of the pleated sidewalls 20 as described above. Because of the separate sump area 43, there is in effect created a well area which will permit near total emptying of contents of the container. Further, the presence of the sump area makes dispensing of the contents of the container easier for the consumer by creating a drawing action on the liquid at the time of suction or squeezing the contents. Relaxation of force on either the mouth induced vacuum or pleated sidewalls 20, will allow air to enter the headspace and result in no increase in effort in consuming the last drop of liquid relative to the first drop.

Figure 5:
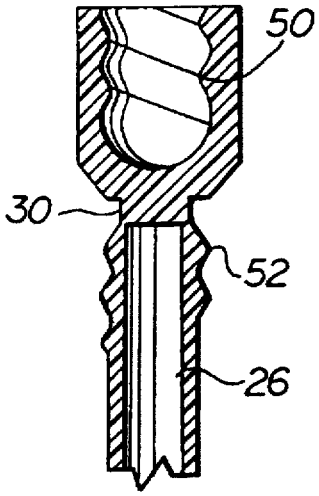
FIG. 5 is an enlarged partial view of an alternative embodiment of a sealing cap for tube of the dispensing container of the present invention.

As shown in FIG. 5, a threaded cap 50 is alternatively provided which is initially inverted and sealed to the second end 26 of the flexible drinking tube 22 by the frangible seal 30. Upon breaking of the frangible seal 30, and dispensing of the contents of the container through the drinking tube 22, the drinking tube 22 may be sealed by virtue of the threaded cap 50 about the exterior threads 52 formed on the end 26 of the flexible drinking tube 22.

Figure 6:
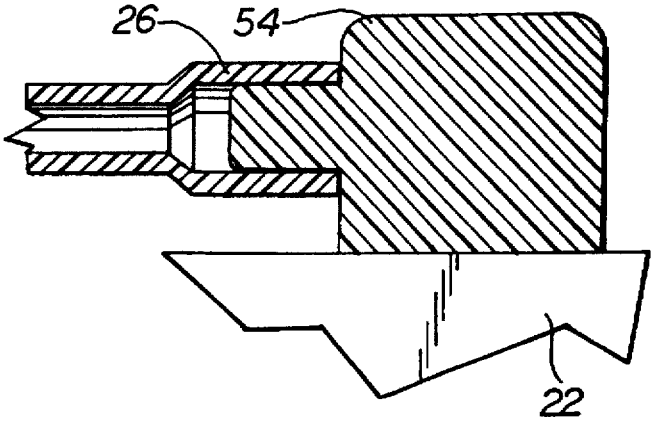
FIG. 6 is an enlarged partial view of still another alternative sealing cap for use with the tube of the dispensing container of the present invention.

Still further, another embodiment is shown in FIG. 6 in which a stopper 54 is integrally provided with the container at an upper surface of the drinking tube 22 such that the opened or used drinking tube 22 may be plugged onto the integral stopper 54 to prevent spilling of the contents of the container when not in use. This avoids the need for a tether 46 as in the FIG. 1 embodiment.

It will be understood that the bottle of the present invention may be molded from a low density polyethylene, the bottle being molded and filled in an inverted position. As formed, there are two openings including the fill opening, also known as the second end 26 of the drinking tube 22 and the vent opening 32. Both openings are sealed concurrently and the consumer only initially opens the flexible drinking tube for dispensing of the contents of the container.

The flexible drinking tube 22 with a flexible elbow or bendable portion 44 is formed to allow the flexible drinking tube to be moved to dispensing positions within a 270 degree arc. A preferred dispensing position of tube 22 along with holding of the container during use is illustrated in FIG. 7. The frangible membrane 28 normally holds the flexible drinking tube 22 flush against the formed drinking tube portion 21 of the container 24 during shipping and handling at retail locations.

Once the flexible drinking tube 22 is released at membrane 28, the consumer breaks off the cap 48 at the frangible seal 30 and consumes from the package either by compressing the pleated sidewalls 20 or by sucking on the open end of the flexible drinking tube 22. Due to the unique shape of the container, dispensing may also occur by gravity if the container is inverted.

When the primary seal is removed at the first end 26 of the drinking tube 22, it is maintained in connection with the container by the tether 46, thereby minimizing a potential for litter.

Figure 8:
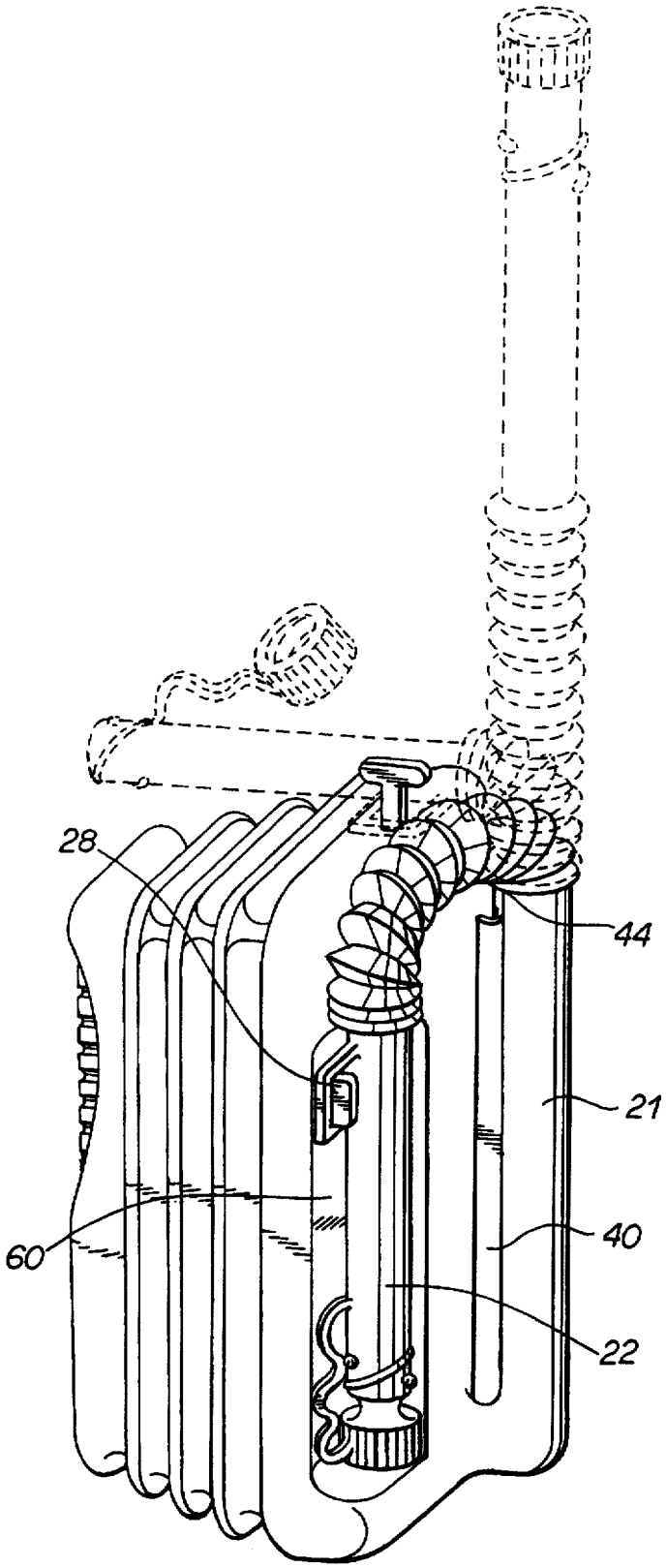
FIG. 8 is a perspective view of an alternative fluid dispensing container.

FIG. 8 is a perspective view of an alternative fluid dispensing container according to the present invention and includes features similar to that described in connection with FIG. 1 except that the formed portion 21 of the drinking tube 22 is substantially straight and the drinking tube from the flexible portion 44 to the dispensing opening 26 is fit against and within a recessed wall portion 60 of the container. The drinking tube 22 is removably connected to the recessed wall by a frangible membrane. The overall appearance of the container shown in FIG. 8 is narrower than that of FIG. 1. Remaining features and modifications thereof in FIG. 8 correspond to those described in connection with FIG. 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A fluid dispensing container comprising:

means for pumping fluid from the container, the means for pumping including a collapsible housing, said collapsible housing including first and second opposing end walls and collapsible side walls connecting the opposing end walls;

a flexible drinking tube provided on the collapsible housing, said flexible drinking tube including a first end connected to said collapsible housing and in liquid communication with the interior of said container and a second end opposite to the first end for dispensing the contents of said container;

means for removably sealing the second end of said flexible drinking tube;

means for removably securing the second end of said drinking tube to said collapsible housing; and a liquid well formed in at least a portion of said drinking tube and including the first end thereof and a formed portion for assisting in the dispensing of the entire contents of the container.

2. The container according to claim 1, further comprising a vent opening formed in the collapsible housing for venting the container upon receiving fill fluid into said container.

3. The container according to claim 2, wherein the second end of the drinking tube has at least one port therein and wherein the container further comprises means for closing the vent opening during dispensing of fluid such that the at least one port in the drinking tube is the only opening during dispensing of fluid from the container.

4. The container according to claim 1, wherein the first opposing end wall of said collapsible housing includes a recessed area conformally shaped to receive at least a portion of a palm of an operator's hand.

5. The container according to claim 4, wherein the recessed area has a non-slip surface.

6. The container according to claim 5, wherein said non-slip surface includes a plurality of spaced and raised ribs extending from the first opposing end wall of said collapsible container.

7. The container according to claim 4, further comprising a finger recess conformably shaped to receive a finger of an operator's hand while the recessed area simultaneously receives the palm of the same operator's hand, the finger recess being at an opposite side of the collapsible housing from the recessed area.

8. The container according to claim 1, wherein said collapsible housing includes pleated sidewalls connecting the opposing end walls, the opposing end walls being rigid, thereby providing an overall accordion shape to said collapsible housing.

9. The container according to claim 8, wherein said collapsible housing and drinking tube are formed of a one-piece construction.

10. The container according to claim 1, wherein said flexible drinking tube is removably secured to said collapsible housing by a frangible membrane adjacent the second end of said flexible drinking tube.

11. The container according to claim 1, wherein the first end of said drinking tube is in liquid communication with an interior portion of said collapsible housing at the second opposing end wall of said collapsible housing.

12. The container according to claim 11, wherein said flexible drinking tube is bendable at an intermediate point between the first and second ends thereof.

13. The container according to claim 12, further comprising a recess formed adjacent the bendable portion of said flexible drinking tube for accommodating the fingers of an operator of the container.

14. The container according to claim 1, wherein said means for removably sealing the second end of said flexible drinking tube includes a reversible sealing member frangibly connected at a first side thereof to the second end of said drinking tube, such that breaking of the frangible portion opens the second end of said drinking tube, the reversible sealing member including a stopper on a side opposite said first side insertable into the second end of said drinking tube after breaking of said frangible portion.

15. The container according to claim 1, wherein said means for removably sealing the second end of said flexible drinking tube includes a cap member removably secured to the second end of said flexible drinking tube.

16. The container according to claim 15, further comprising a tether connecting the second end of said drinking tube to the cap, thereby permanently connecting the cap to said container.

17. The container according to claim 1, further comprising a projection formed on the surface of said housing in proximity to the second end of said flexible drinking tube, such that the second end of said flexible drinking tube sealingly fits on said projection when not in use for dispensing.

18. The container according to claim 1, wherein said container is entirely formed of blow-molded plastic and is of a one-piece construction.

19. The container according to claim 1, further comprising a recessed area in the opposing end wall of the collapsible housing, the recessed area being contoured to receive at least a portion of a palm of an operator's hand whereby a portion of the first opposing end wall and a portion of the collapsible side walls are partially enclosable by the operator's hand.

20. The container according to claim 1, wherein the second end of the drinking tube has at least one port therein and all of the ports in the second end of the drinking tube being the only openings during dispensing of fluid from the container.

21. The container according to claim 1, wherein the housing has a generally rectangular shape without any openings extending completely therethrough.

22. A fluid dispensing container comprising:

a collapsible housing having a top and bottom, said collapsible housing including first and second opposing end walls and collapsible side walls connecting the opposing end walls;

a recessed area formed in the second opposing end wall;

a flexible drinking tube provided on the collapsible housing, said flexible drinking tube including a first end connected to the bottom of said collapsible housing and in liquid communication with the interior of said container, a formed portion connected to the second opposing end of said container, a free portion extending from the formed portion, and a second end opposite to the first end for dispensing the contents of said container, a connection between the free portion and the formed portion being adjacent the top of the collapsible housing during dispensing of fluid;

means for removably sealing the second end of said flexible drinking tube; and means for removable securing the free portion of said drinking tube within the recessed area of the second opposing end wall of said collapsible housing.

23. The container according to claim 22, further comprising a second recessed area in the first opposing end wall of the housing, the second recessed area being contoured to receive at least a portion of a palm of an operator's hand whereby a portion of the first opposing end wall and a portion of the collapsible side walls are partially enclosable by the operator's hand.

24. The container according to claim 22, further comprising means for forming a sump in the formed portion of the drinking tube.

25. The container according to claim 22, wherein the formed portion of the drinking tube is one of straight or curved.

26. The container according to claim 22, wherein the collapsible housing is means for pumping fluid from the container such that upon repeated compression of the collapsible side walls, generally all fluid is dispensable from within the container.

27. A fluid dispensing container comprising:

means for pumping fluid from the container, the means for pumping including a collapsible housing, said collapsible housing including first and second opposing end walls and collapsible side walls connecting the opposing end walls, the first opposing end wall of the collapsible housing includes a recessed area conformally shaped to receive at least a portion of a palm of an operator's hand;

a finger recess conformably shaped to receive a finger of an operator's hand while the recessed area simultaneously receives the palm of the same operator's hand, the finger recess being at an opposite side of the collapsible housing from the recessed area;

a flexible drinking tube provided on the collapsible housing, said flexible drinking tube including a first end connected to said collapsible housing and in liquid communication with the interior of said container and a second end opposite to the first end for dispensing the contents of said container;

means for removably sealing the second end of said flexible drinking tube; and means for removably securing the second end of said drinking tube to said collapsible housing.

28. The container according to claim 27, wherein the recessed area has a non-slip surface, the non-slip surface including a plurality of spaced and raised ribs extending from the first opposing end wall of said collapsible container.

29. The container according to claim 27, wherein the collapsible housing includes pleated sidewalls connecting the opposing end walls, the opposing end walls being rigid, thereby providing an overall accordion shape to said collapsible housing.

30. The container according to claim 27, wherein the collapsible housing and drinking tube are of a one-piece construction.

31. The container according to claim 27, wherein the flexible drinking tube is removably secured to said collapsible housing by a frangible member adjacent the second end of said flexible drinking tube.

32. The container according to claim 27, wherein the first end of said drinking tube is in liquid communication with an interior portion of said collapsible housing at the second opposing end wall of said collapsible housing.

33. The container according to claim 27, wherein the flexible drinking tube is bendable at an intermediate point between the first and second ends thereof.

34. The container according to claim 27, further comprising a liquid well formed in at least a portion of said drinking tube means for forming a sump in the formed portion of the drinking tube.

35. A fluid dispensing container comprising:

means for repeatedly pumping substantially all fluid from the container, the means for pumping including a collapsible housing, said collapsible housing including first and second opposing end walls and collapsible side walls connecting the opposing end walls;

a flexible drinking tube provided on the collapsible housing, said flexible drinking tube including a first end connected to said collapsible housing and in liquid communication with the interior of said container and a second end opposite to the first end for dispensing the contents of said container;

means for removably sealing the second end of said flexible drinking tube;

means for removably securing the second end of said drinking tube to said collapsible housing; and a finger recess conformably shaped to receive a finger of an operator's hand while the recessed area simultaneously receives the palm of the same operator's hand, the finger recess being at an opposite side of the collapsible housing from the recessed area.

36. The container according to claim 35, wherein the collapsible housing includes pleated sidewalls connecting the opposing end walls, the opposing end walls being rigid, thereby providing an overall accordion shape to said collapsible housing.

37. The container according to claim 35, wherein the collapsible housing and drinking tube are of a one-piece construction.

38. The container according to claim 35, wherein the flexible drinking tube is removably secured to said collapsible housing by a frangible member adjacent the second end of said flexible drinking tube.

39. The container according to claim 35, wherein the first end of said drinking tube is in liquid communication with an interior portion of said collapsible housing at the second opposing end wall of said collapsible housing.

40. The container according to claim 35, wherein the flexible drinking tube is bendable at an intermediate point between the first and second ends thereof.

41. The container according to claim 35, further comprising a liquid well formed in at least a portion of said drinking tube means for forming a sump in the formed portion of the drinking tube.

* * * * *